United States Patent [19]

Nash et al.

[11] 4,265,283

[45] May 5, 1981

[54] WORK BENCH STRUCTURE

[75] Inventors: Edward M. Nash, Michigan City, Ind.; Edward M. Johnson, Jr., Matteson, Ill.

[73] Assignee: The Triangle Corporation, Grant Park, Ill.

[21] Appl. No.: 589

[22] Filed: Jan. 2, 1979

[51] Int. Cl.[3] ..... B27C 5/10; S27C 9/00

[52] U.S. Cl. ..... 144/286 R; 108/8; 108/113; 144/1 R; 144/286 A

[58] Field of Search ..... 144/285 R, 286 R, 286 A, 144/1 R, 1 C, 1 G, 1 H; 83/574, 477.2; 312/257.5 M, 257.5 K; 108/8, 62, 13, 111

[56] References Cited

U.S. PATENT DOCUMENTS

| | | | |
|---|---|---|---|
| 886,077 | 4/1908 | Rowe | 108/62 X |
| 1,153,946 | 9/1915 | Ohnstrand | 144/286 R |
| 2,660,205 | 11/1953 | Yetter | 144/1 R X |
| 2,662,566 | 12/1953 | Kurschner | 144/286 |
| 2,759,507 | 8/1956 | Davis et al. | 144/285 |
| 2,786,500 | 3/1957 | Unterfranz | 144/285 |
| 3,598,066 | 8/1971 | Polezoes | 108/111 |
| 4,114,665 | 9/1978 | Decker | 144/286 R |

FOREIGN PATENT DOCUMENTS

| | | | |
|---|---|---|---|
| 570609 | 12/1957 | Italy | 144/1 R |
| 1268014 | 3/1972 | United Kingdom | 144/286 A |

*Primary Examiner*—W. D. Bray

*Attorney, Agent, or Firm*—Harness, Dickey & Pierce

[57] ABSTRACT

A work bench adapted for mounting a plurality of electrically operated hand tools such as saber saws, routers, and circular saws, has a normally horizontal top rotatably supported between a pair of vertical side support members. The normally upwardly facing surface of the top has a pair of upwardly facing channels for slidably receiving a miter guide therein, while the bottom surface of the top has a plurality of downwardly facing channel shaped members which cooperate with clamp means for clampingly securing tools to the bottom surface of the top. The top has a central opening through which the cutting blade or bit of a clamped tool can extend.

9 Claims, 9 Drawing Figures

FIG. 1.
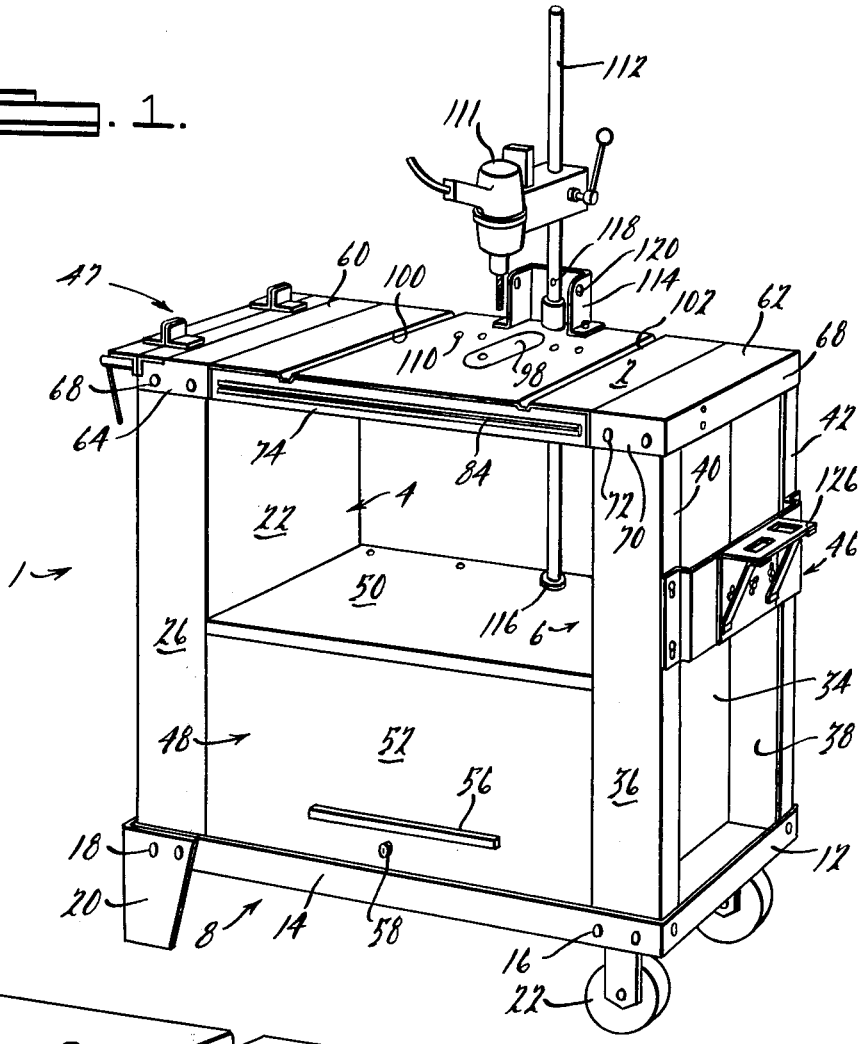
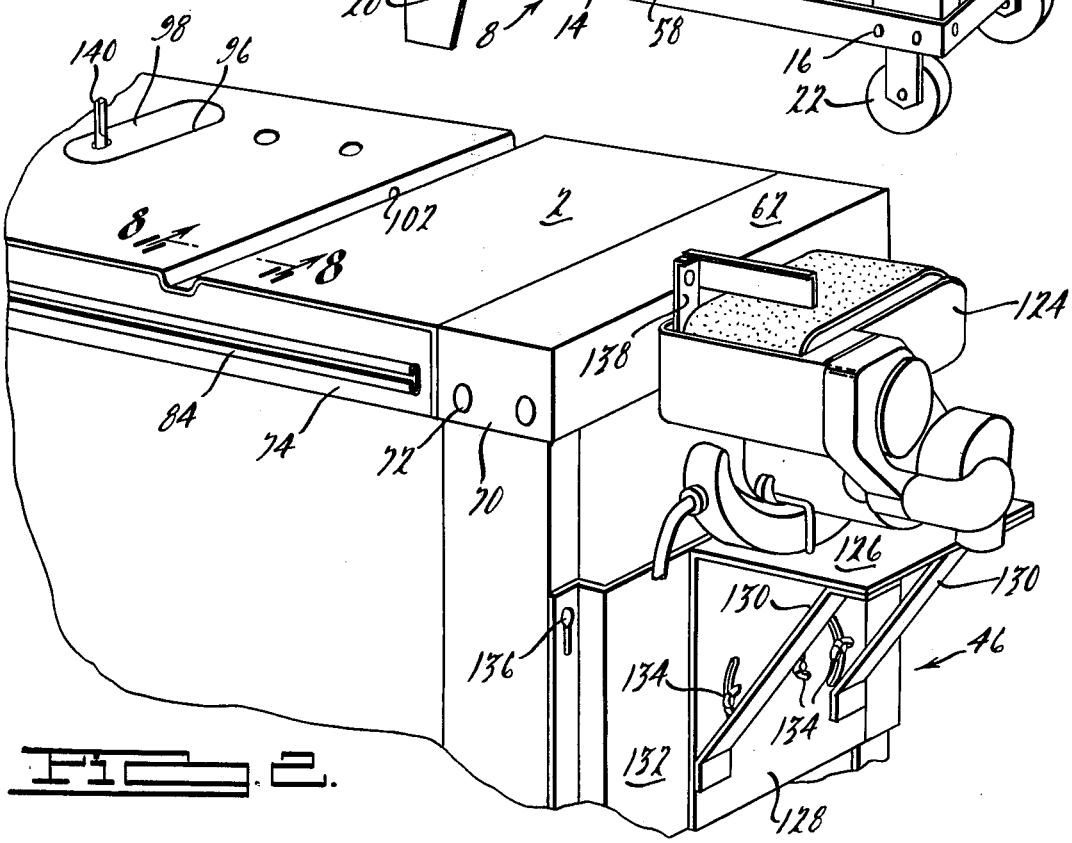
FIG. 2.

FIG. 3.
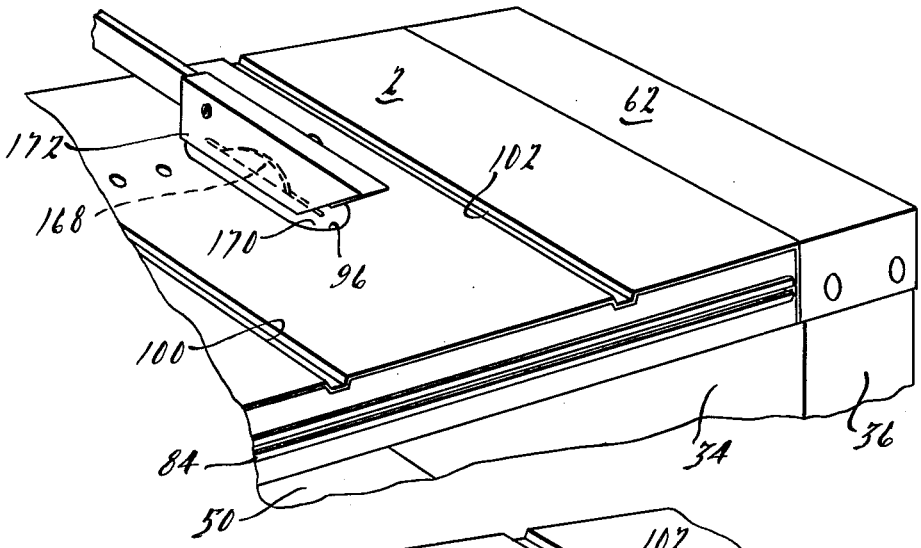
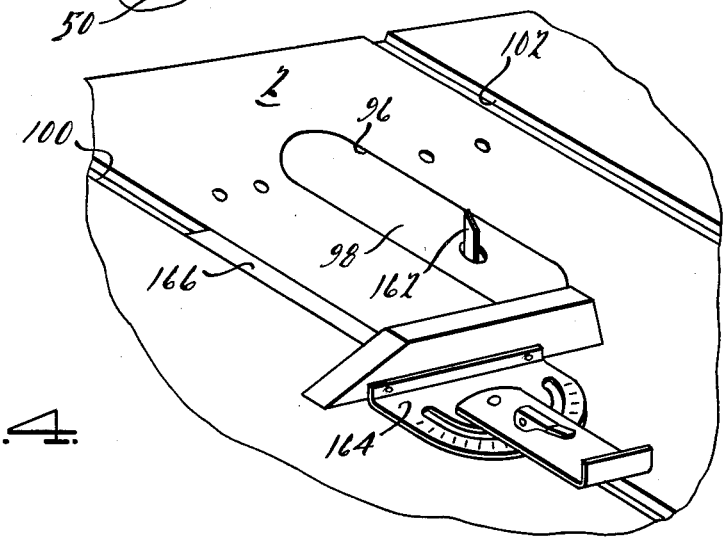
FIG. 4.
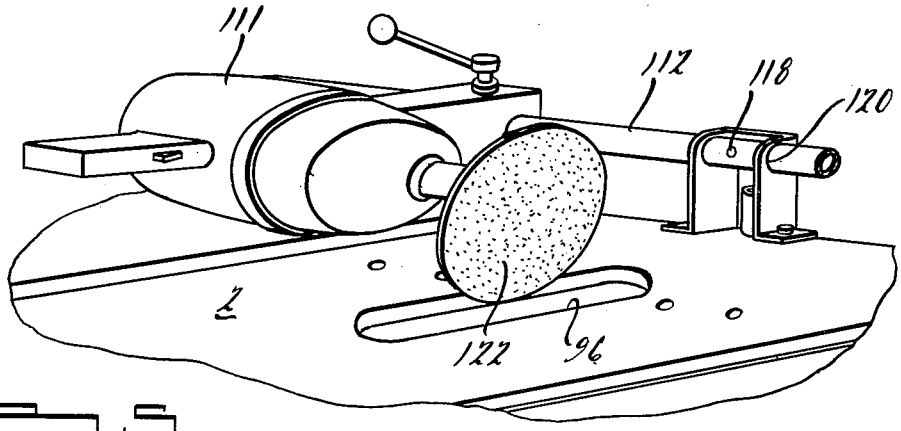
FIG. 5.

FIG. 6.
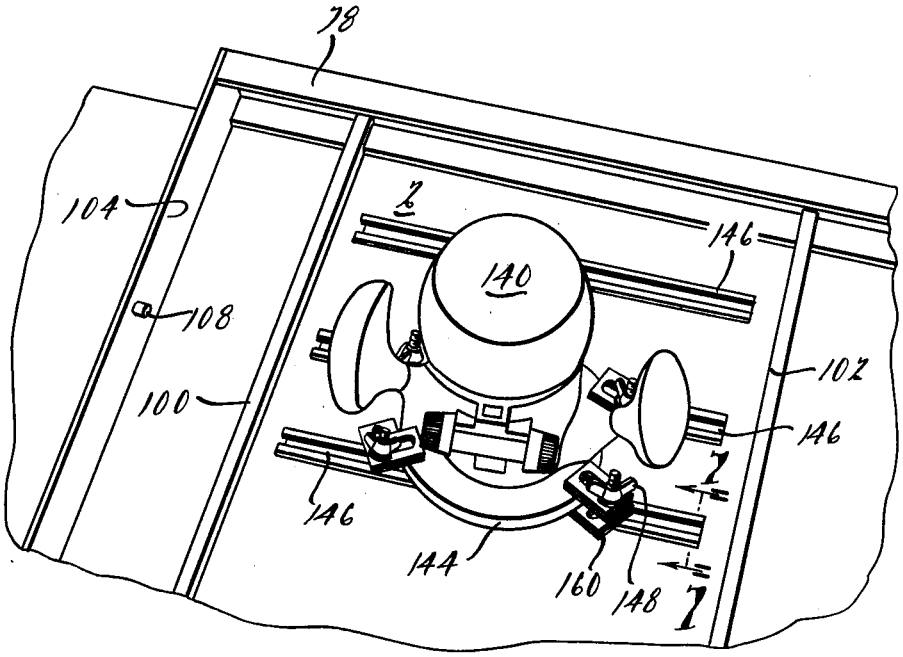
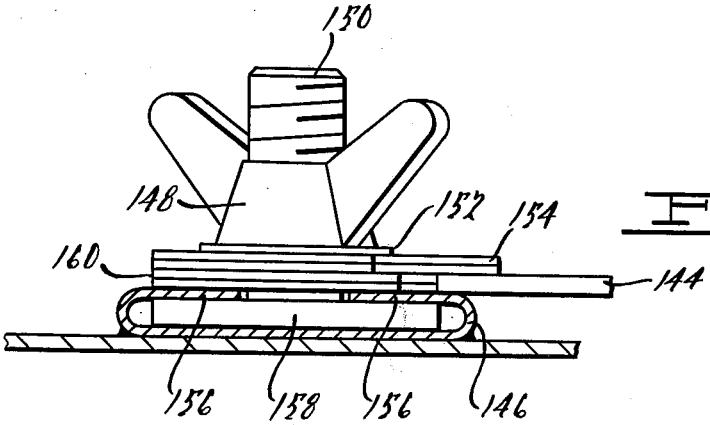
FIG. 7.
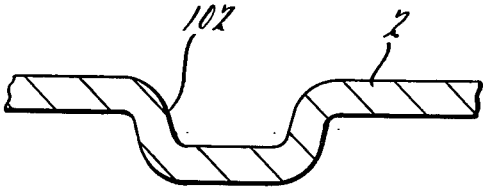
FIG. 8.

WORK BENCH STRUCTURE

BACKGROUND OF THE INVENTION

The present invention relates to a multi-purpose work bench having means thereon for mounting a plurality of different tools. More particularly, the present invention relates to a portable multi-purpose work bench made of stamped sheet metal and having means for mounting a plurality of different, normally hand-held electrically powered tools.

Although multi-purpose work tables are known in the art, there remains a need for a portable work bench which can be economically manufactured and can be used to support a plurality of different tools and workpieces in a useful manner. There also remains a need for a work center which can be adapted for use with several different electrically powered hand tools such as saber saws, circular saws, routers, belt sanders, and drills.

Wherefore, it is an object of the present invention to provide a multi-purpose, mobile work bench which is economically manufactured and has means for supporting a plurality of different electrically powered hand tools. Another object of this invention is to provide a work bench which has means for converting various portable, electrically operated, normally hand-held power tools to stationary power tools which can be used with improved control and accuracy. These and other objects, features and advantages of the present invention will be apparent from the following description and appended claims, taken in conjunction with the accompanying drawings.

BRIEF DESCRIPTION OF THE DRAWING

FIG. 1 is a perspective view of a work bench of the present invention with a portable drill mounted thereon;

FIG. 2 is a perspective view, broken away, of a work bench of the present invention with a router and a belt sander mounted thereon;

FIG. 3 is a perspective view, broken away, of the work bench with a circular saw mounted thereon;

FIG. 4 is a perspective view, broken away, of the work bench with a saber saw and a miter guide mounted thereon;

FIG. 6 is a perspective view, broken away, of the bottom surface of a top member of a work bench of this invention having a router mounted thereon;

FIG. 7 is a sectional view taken along the lines 7—7 in FIG. 6;

FIG. 8 is a sectional view taken along lines 8—8 in FIG. 2; and

FIG. 9 is an exploded view showing the general construction of a work bench of this invention.

DESCRIPTION OF THE INVENTION

Figure 5:
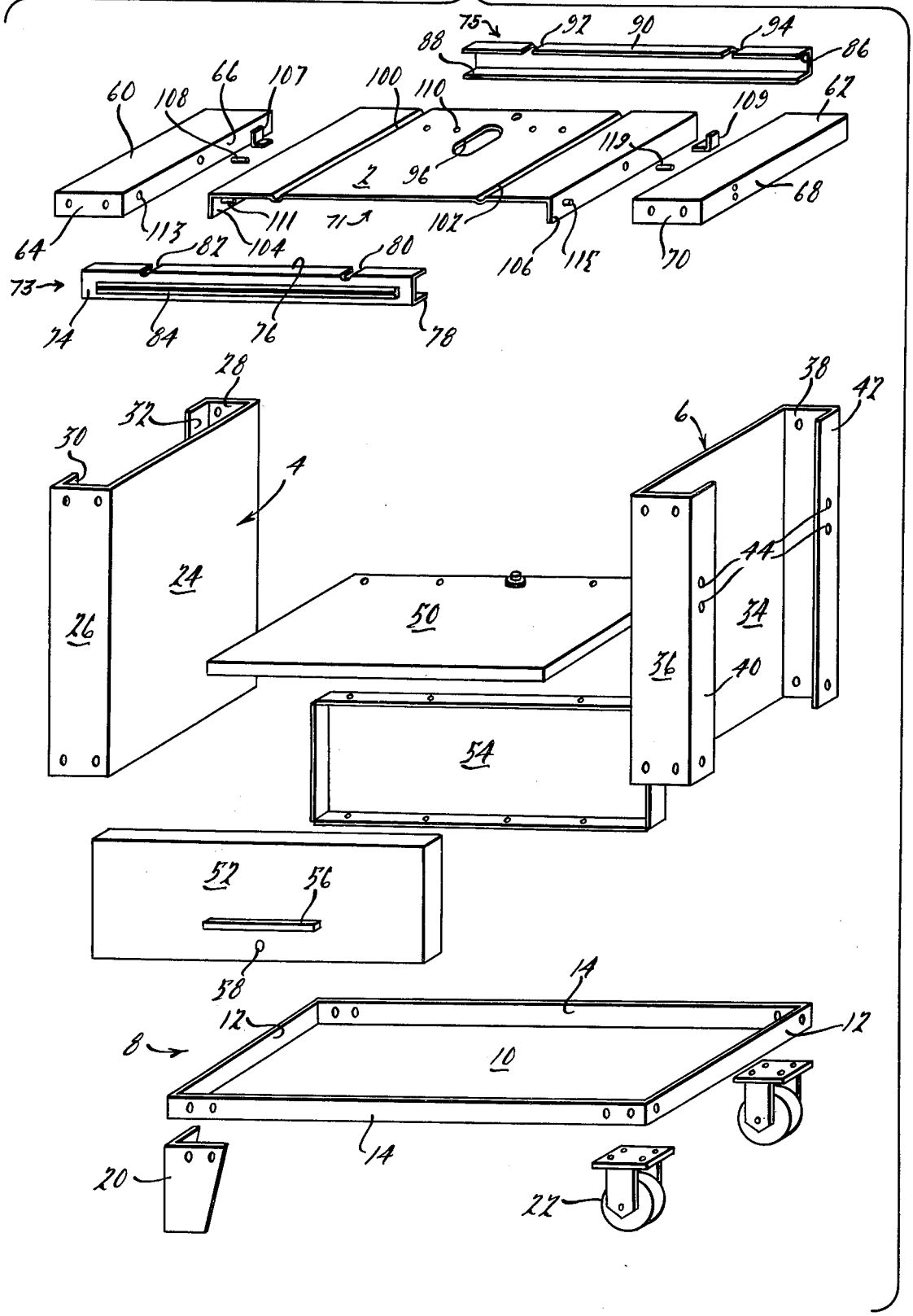
FIG. 5 is a perspective view, broken away, of the work bench having mounted thereon a portable drill in a disc sander configuration.

Now referring to the Figures, a multi-purpose work bench of the present invention is generally indicated by the numeral 1 and is shown in perspective view in FIG. 1. Generally speaking, work bench 1 has a top 2, supported between a pair of vertical support members 4 and 6 which, in turn are supported on base 8. As set forth in more detail hereinafter, each of top 2, vertical support members 4 and 6, and base 8 are designed to be comprised of stamped sheet metal pieces so that a strong work bench can be obtained at reasonable costs for material and manufacturing.

As best shown in FIG. 9, base 8 has a generally planar, horizontally disposed portion 10 with upwardly extending, integrally formed flanges 12 and 14 which provide increased structural integrity to base 8 and have apertures therein for receiving bolts 16 and 18 for attaching vertical support members 4 and 6 thereto. Base 8, in top plan view, is of rectangular configuration and is itself supported at each corner by a pair of legs 20 and a pair of wheels 22 which allow work bench 1 to be moved by one person lifting up legs 20 and pushing or pulling work bench 1 on wheels 20.

Vertical support members 4 and 6 are each of generally channel-shaped, cross section with outboard facing channel openings. Vertical support member 4 has a web portion 24 with integrally formed legs 26 and 28 and inwardly turned edge flanges 30 and 32. Vertical support member 6 is of similar design having web portion 34 with integrally formed legs 36 and 38 and inwardly turned edge flanges 40 and 42. Edge flanges 30, 32, 40 and 42 can be adapted to support shelves or vises, as set forth hereinafter, by providing fastener receiving apertures 44 therein.

Disposed between vertical support members 4 and 6 is a storage box generally indicated by numeral 48. Storage box 48 is of rectangular box-like shape and has a top 50, front wall 52, and back wall 54 which combine with webs 24 and 34 and base 8 to form the enclosure of storage box 48. Front wall 52 is hingedly attached to top 50 and has a handle 56 and lock means 58 to facilitate opening and locking storage box 48. Top 50 and back wall 54 can be fixedly attached to each other and webs 24 and 34 and base 8 as by bolts or other conventional fastening means.

Capping vertical support members 24 and 34 are top caps 60 and 62 respectively. Top cap 60 has integral side flanges 66 and end flanges 64 which are attached to legs 26 and 28 of vertical support member 4 by means of bolts 68. Top cap 62 similarly has integral side flanges 68 and end flanges 70 which are attached to legs 36 and 38 of vertical support member 6 by bolts 72.

Top 2 is supported between top caps 60 and 62 and includes a central portion 71 to which front and rear caps 73 and 75 are attached. Front cap 73 is of generally channel-shaped cross section, having web portion 74 and legs 76 and 78. Leg 76 is attached to the underside of central portion 71 by welding or other conventional means and has notches 80 and 82 therein to accomodate channels 100 and 102 which are stamped into central portion 71. An elongated channel member 84 is welded or otherwise fixedly attached to web 74 to facilitate use of a conventional rip fence with top 2. Rear cap 75 has a construction symmetrical to front cap 73, having web 86, legs 88 and 90, notches 82 and 94 in leg 90 to accomodate channels 100 and 102 and an elongated channel member (not shown) identical to member 84 attached to web 86 for use with a rip fence. Leg 90 is welded or otherwise attached to the underside of central portion 71.

Central portion 71 of top 2 is pivotally attached to inboard side flanges 66 and 68 of top caps 60 and 62 respectively by pivot means such as bolts 108 and 119. To maintain top 2 in a normal, horizontal position, L-shaped pivot stops 107 and 109 are employed proximate to the rear of top 2 as pivot rests for the lower edges of flanges 104 and 106 of central portion 71. Spring loaded pivot stop pins 111 and 115 are employed proximate to the front of top 2 to selectively lock top 2 in a horizontal position. For example, stop pin 111 is normally spring biased to a leftward position (as viewed in FIG. 9) to extend into aperture 113 and prevent pivotal movement of top 2. Thus to pivot top 2 to obtain easy access to the underside thereof for attaching tools thereto, one merely pulls pins 111 and 115 each in the direction toward the other until each clears the respective aperture in flanges 66 and 68 whereupon the front of top 2 can be pivoted downwardly.

Central portion 71 of top 2 has an elongated aperture 96 which is adapted to receive and locate inserts such as insert 98 for use with various power tools. In addition, central portion 71 has a plurality of aligned holes 110 for attachment of a guide means for use with a router or drill press. Also located in central portion 71 are channels 100 and 102 which can be stamped in central portion 71 and which provide a guide means for a miter guide as described in more detail below. FIG. 8, which is a cross-sectional view of channel 102, shows that channel 102 is indented in the top surface and correspondingly projects from the bottom surface of top 2. As shown best in FIG. 6, the under surface of top 2 has a plurality of elongated channel-shaped members 146 which provide means for attaching the base plates of various tools to the under surface of the table top. The structure of elongated channel-shaped members 146 is best shown in FIG. 7. Members 146 are identical in cross-section to elongated channel-shaped members 84 used in conjunction with a rip fence.

Further understanding of the present invention will be obtained from the following description of the operation of work bench 1. Thus, as shown in FIG. 1, top 2 of work bench 1 supports a bracket 114 which is bolted thereto. Extending vertically through bracket 114 is post 112 which provides mounting means for electric drill 111. Post 112 extends through bracket 114, being attached thereto by bolt means 118, and has a bottom portion which is supported on base projection 116 attached to the top of storage box 48. Bracket 114 also has apertures 120 in horizontal alignment and through which post 112 can be placed and secured by bolt 118 to horizontally mount drill 111 as shown in FIG. 5. Thus, in this manner drill 111 can provide rotation to a sanding disc 122 mounted thereon and extending into elongated aperture 96.

If it is desired to mount and use router 140 with work bench 1, it is necessary to mount the base plate 144 of the router to the undersurface of central portion 71 of top 2. The mounting or dismounting operation is, of course, greatly facilitated by rotating top 2 to an inverted position. Then suitable clamp means can be employed with elongated channel shaped members 146 to clampingly engage base plate 144 to top 2. Thus, and as best shown in FIG. 7, a bolt 150 has a headed portion 158 located within channel shaped member 146 and inwardly bent leg portions 156. Wing nut 148 having shoulder 152 is threadably attached to bolt 150 and when rotated in a clamping direction urges shoulder 152 against rectangular clamp 154 which in turn clampingly engages base plate 144 against the upper surfaces of inwardly bent leg portions 156. Rectangular guide 160 is placed with an edge in abutting relationship to an edge of base plate 144 to facilitate the location thereof with respect to the clamping means.

In an analagous manner, circular saw 168 or rip saw 162 can be attached to top 2 for use with work bench 1. An insert 170 of appropriate shape can be employed with saw 168. Also a conventional blade guard 172 and a miter guide 164 having guide arm 166 slidably located in channel 100 or 102 can be employed.

Vertical support member 4 can be used to support a vise 47, while vertical support member 6 can be used to support shelf 46 and belt sander as best shown in FIG. 2. Thus, belt sander 124 is clamped to a horizontal ledge 126 which is supported on integral vertical plate 128 by braces 130. Vertical plate 128 is adjustably attached to vertical bracket 132 by means of three fasteners 134, the center fastener providing pivot means and the other two fasteners being located in moon shaped apertures to allow for limited pivotal movement of vertical plate 128. Vertical bracket 132 is attached to vertical support member 6 by bolts 136 or other suitable fastening means. A sanding stop member 138 can be attached to top cap 62 for use with sander 124. By pivoting vertical plate 128 with respect to vertical bracket 132, the sander 124 can be adjusted to a level position.

It will be appreciated that the above disclosed embodiment is well calculated to achieve the aforementioned objects of the present invention. In addition, it is evident that those skilled in the art, once given the benefit of the foregoing disclosure, may now make modifications of the specific embodiment described herein without departing from the spirit of the present invention. Such modifications are to be considered within the scope of the present invention which is limited solely by the scope and spirit of the appended claims.

What is claimed is:

1. A workbench construction adaptable for use with a plurality of removable electrically powered hand tools each having a different cutting device, said construction including: a rectangular base member; a pair of vertical support members extending upwardly from opposite side portions of said base member, each having a width substantially coextensive with the associated side portion of said base member and each being generally channel-shaped in horizontal cross-section; a normally horizontally disposed top member selectively pivotally supported along a horizontal axis extending through a center portion thereof, said top member being supported between respective upper end portions of said pair of vertical support members and at opposite ends of said horizontal axis by pivot means; an end cap member attached to the top of each of said vertical support members, each end cap member having a horizontal planar portion substantially coplanar with said top member when said top member is in a horizontal position; means on said end caps and said top member defining said pivot means, said means on said end caps and said top member being disposed intermediate the width of said support members and said end caps; said top member having an aperture therein and mounting means attached to the underside of said top member for mounting one of said plurality of tools with the cutting device being extendable through said aperture.

2. A workbench construction as in claim 1 including pivot stop means for supporting said top member in a horizontal position.

3. A workbench construction as in claim 2 wherein said mounting means comprises a plurality of parallel elongated members having a channel shaped cross section with inwardly directed leg end portions.

4. A workbench construction as in claim 3 wherein said base member, pair of vertical support members and top member are made of stamped sheet metal.

5. A workbench construction as in claim 4 wherein said top member comprises a central portion of generally planar configuration, a pair of side flanges integrally formed therewith, and a pair of elongated channels formed therein, said elongated channels being adapted to slidably guide a miter guide therein, and front and rear end cap members, each of generally channel-shaped cross section and having a leg attached to the underside of said central portion; said leg having a pair of notches therein for receiving said pair of elongated channels.

6. A workbench construction as in claim 5 including a shelf member for supporting a belt sander, said shelf member being pivotally attached to one of said pair of vertical support members.

7. A workbench construction as in claim 6 including a vise member, said vise member being attached to the other of said vertical support members.

8. A workbench construction as in claim 7 including a drill support member removably attached to and extending vertically upwardly from, said top member.

9. A workbench construction as in claim 8 including an enclosure, the bottom of said enclosure comprising said base member and two sides thereof comprising said vertical support members.

* * * * *